US007634942B2

(12) United States Patent
Green et al.

(10) Patent No.: US 7,634,942 B2
(45) **Date of Patent: *Dec. 22, 2009**

(54) TUBING EXPANSION

(75) Inventors: Annabel Green, Scotland (GB); Simon John Harrall, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/208,493

(22) Filed: Sep. 11, 2008

(65) Prior Publication Data

US 2009/0000794 A1 Jan. 1, 2009

Related U.S. Application Data

(63) Continuation of application No. 11/549,546, filed on Oct. 13, 2006, now Pat. No. 7,500,389.

(30) Foreign Application Priority Data

Oct. 14, 2005 (GB) ..... 0520860.8

(51) Int. Cl.
*E21B 49/00* (2006.01)
*E21B 43/10* (2006.01)

(52) U.S. Cl. ..... 73/152.57; 166/207

(58) Field of Classification Search ..... 73/152.54, 73/152.57; 166/207

See application file for complete search history.

(56) References Cited

U.S. PATENT DOCUMENTS 3,049,752 A * 8/1962 Jorda et al. ..... 425/385
3,678,560 A * 7/1972 Dufour et al. ..... 29/235
3,905,227 A * 9/1975 Kinley ..... 73/152.57
4,204,426 A * 5/1980 Patton et al. ..... 73/152.54
4,616,987 A * 10/1986 Boyers et al. ..... 425/89
5,271,469 A * 12/1993 Brooks et al. ..... 166/387
5,271,472 A * 12/1993 Leturno ..... 175/107
5,947,213 A * 9/1999 Angle et al. ..... 175/24
6,112,809 A * 9/2000 Angle ..... 166/66
6,296,057 B2 * 10/2001 Thiercelin ..... 166/285
6,843,317 B2 * 1/2005 Mackenzie ..... 166/254.2
6,880,632 B2 4/2005 Tom et al.
7,182,141 B2 * 2/2007 Tran et al. ..... 166/384
7,215,125 B2 5/2007 Clark
7,500,389 B2 * 3/2009 Green et al. ..... 73/152.57
2003/0111234 A1 * 6/2003 McClurkin et al. ..... 166/384

(Continued)

FOREIGN PATENT DOCUMENTS

GB 293986 7/1928

(Continued)

OTHER PUBLICATIONS

GB Search Report, Application No. GB0520860.8, dated Nov. 22, 2005.

(Continued)

*Primary Examiner*—John Fitzgerald
(74) *Attorney, Agent, or Firm*—Patterson & Sheridan, LLP

(57) ABSTRACT

A method of expanding a tubular downhole comprises mounting a sensing device in a downhole tubular to be expanded, expanding at least a portion of the tubular and then engaging the sensing device with a retrieving device. The sensing device is then translated through the expanded tubular.

20 Claims, 4 Drawing Sheets

U.S. PATENT DOCUMENTS

| | | | | |
|---|---|---|---|---|
| 2004/0099424 | A1* | 5/2004 | Smith | 166/382 |
| 2004/0154797 | A1 | 8/2004 | Carmody et al. | |
| 2004/0163819 | A1* | 8/2004 | Johnson et al. | 166/369 |
| 2004/0216925 | A1 | 11/2004 | Metcalfe et al. | |
| 2005/0173109 | A1* | 8/2005 | Cameron | 166/206 |
| 2005/0173130 | A1* | 8/2005 | Richard | 166/384 |
| 2005/0279514 | A1* | 12/2005 | Metcalfe | 166/382 |
| 2005/0279515 | A1* | 12/2005 | Cameron | 166/384 |
| 2006/0027376 | A1* | 2/2006 | Schetky et al. | 166/380 |
| 2007/0151360 | A1* | 7/2007 | Ring et al. | 73/834 |
| 2008/0083533 | A1* | 4/2008 | Malone et al. | 166/254.2 |

FOREIGN PATENT DOCUMENTS

| | | |
|---|---|---|
| GB | 2 393 986 | 4/2004 |
| JP | 03271418 | 12/1991 |
| WO | WO 01/33037 | 5/2001 |
| WO | WO 03/036025 | 5/2003 |
| WO | WO 2004/083591 | 9/2004 |
| WO | WO 2005/005772 | 1/2005 |

OTHER PUBLICATIONS

GB Search Report, Application No. GB0620285.7, dated Jan. 16, 2007.

* cited by examiner

TUBING EXPANSION

CROSS-REFERENCE TO RELATED APPLICATIONS

This application is a continuation of U.S. patent application Ser. No. 11/549,546, filed Oct. 13, 2006, now U.S. Pat. No. 7,500,389, which claims benefit of Great Britain patent application serial number 0520860.8, filed Oct. 14, 2005, which are herein incorporated by reference in their entirety.

BACKGROUND OF THE INVENTION

1. Field of the Invention

This invention relates to tubing expansion and, in particular, to the expansion of tubing downhole.

2. Description of the Related Art

In recent years there have been many proposals relating to expanding tubulars downhole, including the expansion of casing, liner and sandscreens. Various expansion tools have been utilised, including fixed diameter expansion cones and compliant roller expansion devices that are intended to expand tubing into contact with the surrounding bore wall, even if the bore wall is non-circular.

Applicant's U.S. Patent Application Publication No US 2004/0065446, the disclosure of which is incorporated herein by reference, describes the provision of a sensor in combination with an expansion device. The sensor may be utilised to measure or detect a condition in the wellbore proximate the expander.

SUMMARY OF THE INVENTION

According to the present invention there is provided a method of determining a feature of a bore lined by an expanded tubular, the method comprising translating a sensing device mounted to an expansion device through a bore lined by an expanded tubular.

Another aspect of the present invention relates to a method of expanding tubing downhole, the method comprising:

expanding a tubular downhole with an expansion device; and translating a sensing device through the expanded tubing, the sensing device tracking the expansion device.

The sensing device may take any appropriate form. In other aspects of the invention, other devices may be translated through the tubing, as an alternative to or in addition to a sensing device. In a preferred embodiment the sensing device may measure the inner diameter or form of the expanded tubular to determine the degree of compliance between the bore wall and the tubular. The form of the bore wall may have been determined previously, as the sensing device is run into the bore, or in a previous logging operation, or may be assumed, and by determining the form of the expanded tubular it is possible to determine whether the expanded tubular has been expanded into contact with the bore wall. For this application the sensing device may take the form of a memory calliper. Other forms of sensing device may serve a similar purpose, for example an ultrasonic transmitting/receiving device or an electromagnetic device may be utilised to identify areas of tubular-to-borehole or tubular-to-tubular contact, and in other applications a similar device may be utilised to determine the quality of cementation or tubular-to-borehole or tubular-to-tubular sealing.

Other sensing tools may provide an indication of tubular wall thickness, thus identifying any potential weak zones resulting from expansion, which may benefit from preventative remedial action.

It may be possible to flow the well while operating the sensing device, and if the sensing device comprises a flowmeter the production profile of the well may then be estimated, providing an indication of completion effectiveness. Alternatively, or in addition, the sensing device may be capable of measuring fluid density or fluid hold-up or some other parameter of fluid or fluid flow.

The sensing device may comprise a camera for recording or transmitting images of the expansion device or of the tubular, or both. The camera may be provided in combination with an appropriate illumination device. The tubular expanding operation may take place in a substantially clear fluid, such as brine, allowing use of a camera which detects human visible light. In other embodiments non-human visible light may be utilised. For example, the camera may be utilised to detect infra-red radiation and thus may detect temperature variations.

In other aspects of the invention a test or treatment tool may be provided rather than, or in addition to, the sensing device. For example, the tool may comprises a resettable test packer, which may be used to verify tubular-to-borehole sealing, or to target chemical treatment of a production/injection zone.

The sensing device may be run into the tubular mounted on or otherwise coupled to the expansion device. Alternatively, the sensing device may be mounted directly to the tubular, rather than the expansion device, for example by locating the device within a blind joint or pup joint of pipe at the bottom of the tubular, such that the device is run into the bore attached to or within the tubular. The expansion device, or an expansion bottom hole assembly (BHA), may pick up the sensing device once a "top-down" expansion operation has been completed, and the expanded tubular logged while the expansion device is retrieved.

The sensing device may be activated at any appropriate point, and may be activated on engagement of the sensing device by the expansion device. This may be achieved by engagement between, for example, a latch and the sensing device. Alternatively, timers, RFID switches, accelerometers or other means may be utilised.

The expansion device may take any appropriate form, and may be a cone or mandrel, or may be a rotary expansion tool. The expansion device may be a fixed diameter device, such as a fixed diameter cone, a variable diameter device, a collapsible device, or a compliant device.

Another aspect of the present invention comprises a method of expanding a tubular downhole, the method comprising:

expanding a tubular in a bore with an expansion device;

translating a sensing device through the bore to determine a feature of the bore; and comparing or correlating said determined feature with a feature of the bore determined at a different time.

The sensing device may be utilised to determine a feature of the bore before, during or after expansion of the tubular.

The sensing device may be translated through the tubular with the expansion device.

The sensing device may be utilised to assist in identifying the most appropriate location for the expandable tubular in the bore. For example, the sensing device may be utilised to provide a real-time log to identify features of the bore, particularly where the bore is open or unlined bore, such as the boundary between oil and water-bearing sand intersected by the bore. These features may correspond to previously identified features, but in certain aspects of the invention the correlating or comparison step may be omitted, and reliance placed solely on the log obtained by the sensing device as the device is run into the bore with the tubular. If the expandable tubular comprises a combination of sandscreen and solid tubing, the sandscreen may be positioned across the oil-bearing sand while the solid tubing may be positioned across the water-bearing sand. The tubular is then positioned and expanded at the most appropriate location in the bore. In other embodiments the tubular may comprise a patch and may be positioned at a location identified or confirmed as being most appropriate by the sensing device.

The sensing device may also be utilised to ensure that the tubular is accurately located in the bore, in accordance with information obtained from previous bore-logging operations and which information will have been utilised to guide the make-up of a string of tubulars to be installed in the bore. The provision of the sensing device allows the operator to position the tubular with greater accuracy relative to the previously logged bore features, thus minimising the depth discrepancies that are known to occur when attempting to locate a tubular at depth in a bore.

Alternatively, or in addition, where a tubular is to be selectively expanded, that is some portions of the tubular will be expanded while other portions are not, or some portions are to be expanded to different diameters, the output of the sensor may be utilised to identify the locations where the tubular should or should not be expanded. For example, the tubular may be expanded where it is desired to contact and support the formation, or where it is desired to engage a seal with the bore wall to prevent flow of fluid along the bore, behind the tubular. In other embodiments, a completion may be installed subsequently within the tubing, and in this case it may be desirable to set packers within non-expanded portions of the tubular, where the form and dimensions of the tubular can be assured.

The determined features of the bore may be information relative to one or more conditions in the bore proximate the expansion device. The feature may comprise a parameter indicative of the quality of the seal between the tubular and the bore wall, tubular wall thickness, or some other feature related to the placement or expansion of the tubular in the bore. Alternatively, or in addition, the feature may relate to a petrophysical parameter. The sensing device may comprise any suitable sensing device which may provide a log or output of appropriate form including but not restricted to gamma ray, nuclear magnetic resonance (NMR), pulse neutron capture (PNC), TDT, CBL, diplog, carbon oxygen and production logs. The feature determined by the sensing device may be compared with a feature determined prior to or during running in the tubular, or prior to the expansion of the tubular, and which feature may have been determined by an open hole log, for example a resistivity, FDC/CNL, gamma ray or sonic log. The open hole log may have been obtained in a logging while drilling (LWD) operation or in a logging operation carried out after drilling. Alternatively, the feature may be determined by seismic means, including but not limited to a feature determined by downhole seismic testing. In other embodiments the feature determined by the sensing device may be compared with a feature determined subsequently, for example after further well completion operations, after the well has been producing for a time, or before a subsequent well workover. The feature may be determined as part of a "4-D" survey, in which features of a production reservoir are determined at time-spaced intervals.

The sensing device may comprise a camera for recording or transmitting images of at least one of the expansion device and the tubular. The tubular expanding operation takes place in a substantially clear fluid allowing use of a camera which detects human visible light, or the camera may detect non-human visible light.

DETAILED DESCRIPTION

Figure 1:
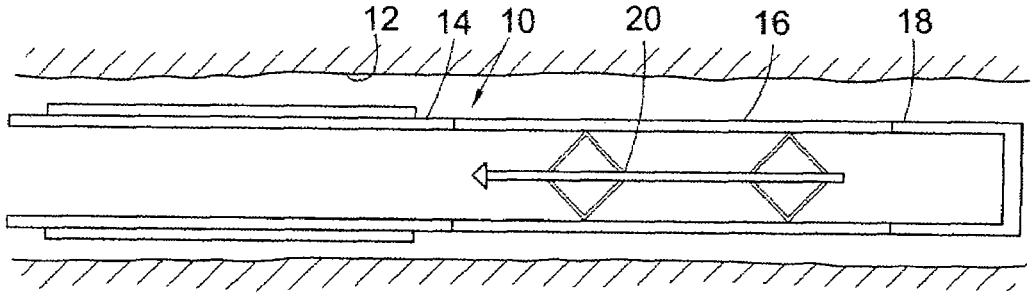
FIGS. 1 and 2 are diagrammatic illustrations of a method of expanding and then logging a tubular in accordance with a preferred embodiment of the present invention.
Figure 2:
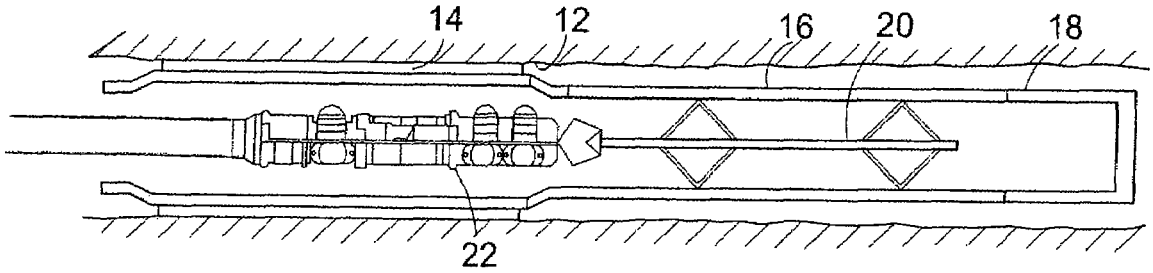

Reference is first made to FIGS. 1 and 2 of the drawings, which illustrate a method of expanding and then logging a tubular in accordance with a preferred embodiment of the present invention.

FIG. 1 includes a diagrammatic illustration of an expandable tubular 10 adapted to be run into a drilled bore, and expanded therein, as illustrated in FIG. 2, such that the walls of the expanded tubular 10 approach or even come into contact with the surrounding bore wall 12. The tubular 10 features an expandable portion 14 and a blank pipe joint 16, located between the expandable portion 14 and the bull nose 18. A memory calliper 20, or other sensing device or devices, is mounted in the blank joint 16 and is run into the bore inside the joint 16.

The expandable portion 14 in this example comprises an expandable sand screen, and as such it is important that full compliance with the bore wall 12 is achieved, that is the expanded sand screen should be expanded into contact with the bore wall 12.

Expansion of the tubular 10 is achieved using an appropriate expansion device 22 which is located within the expandable portion 14, activated, and then translated through the expandable portion 14. Following completion of the expansion operation, the expansion device 22 is translated towards the memory calliper 20 and a latch 24 on the expansion device 22 engages a profile 26 on the calliper 20. The expansion device 22 and memory calliper 20 are then retrieved through the expanded tubular, the form of the expanded tubular being logged as the calliper 20 is retrieved through the expanded tubular.

The memory calliper log can remain on for the entire time the memory calliper 20 is downhole, alternatively the memory calliper log may only be turned on when the calliper 20 is latched by the expansion device 22 using a mechanical arrangement, or using alternative solutions, such as a timer, RFID switches, accelerometers, or the like.

Figure 3:
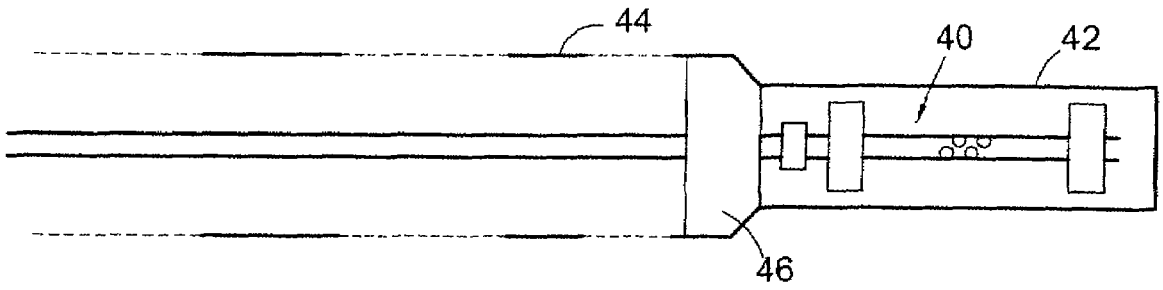
FIGS. 3 and 4 are diagrammatic illustrations of a method of expanding a tubular and then chemically treating a production zone in accordance with a further embodiment of the present invention.
Figure 4:
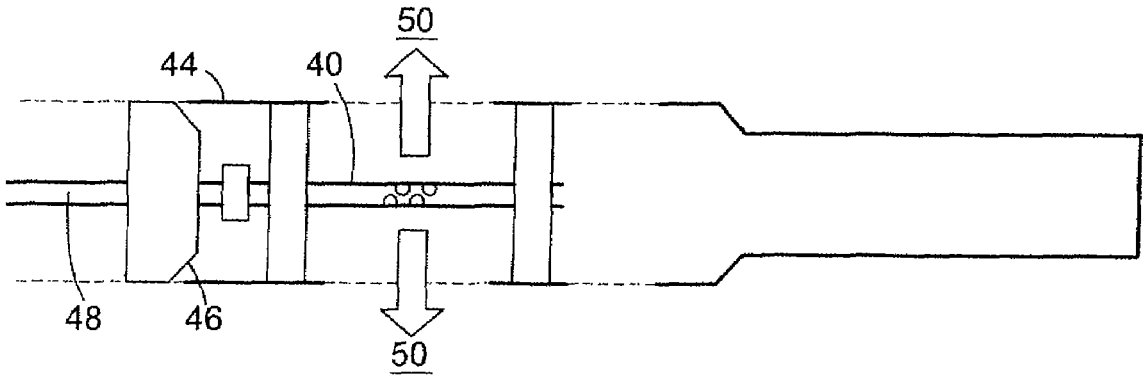

Reference is now made to FIGS. 3 and 4 of the drawings, which illustrate a tubular expansion and chemical treatment method in accordance with a further embodiment of the present invention.

FIG. 3 shows a resettable test packer 40 which has been provided in a pipe joint 42 mounted on the lower end of an expandable tubular string 44. FIG. 3 shows the tubular 44 post expansion, that is after an expansion cone 46 has been run down through the tubular string 44 and has latched on to the packer 40.

The expansion cone 46 and packer 40 are then retrieved part way through the tubular 44, and the test packer 40 located at a suitable point in the expanded tubular string 44. As shown in FIG. 4, the packer 40 may then be activated and a chemical treatment fluid pumped down through the tool string 48 into an adjacent production zone 50.

The packer 40 may be deactivated and then reset at other locations, as appropriate, or retrieved from the bore after a single chemical treatment operation.

Figure 5:
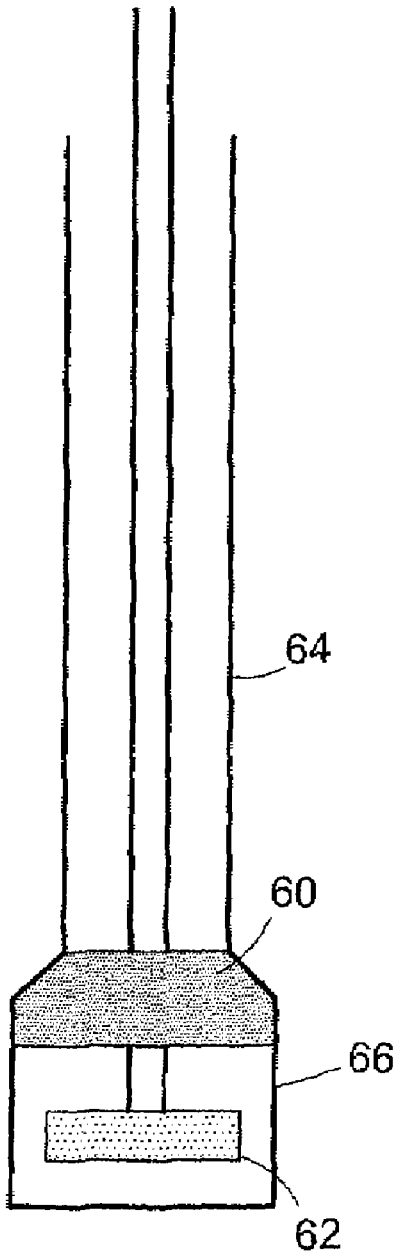
FIGS. 5 and 6 are diagrammatic illustrations of a method of expanding and logging a tubular in accordance with another embodiment of the present invention.
Figure 6:
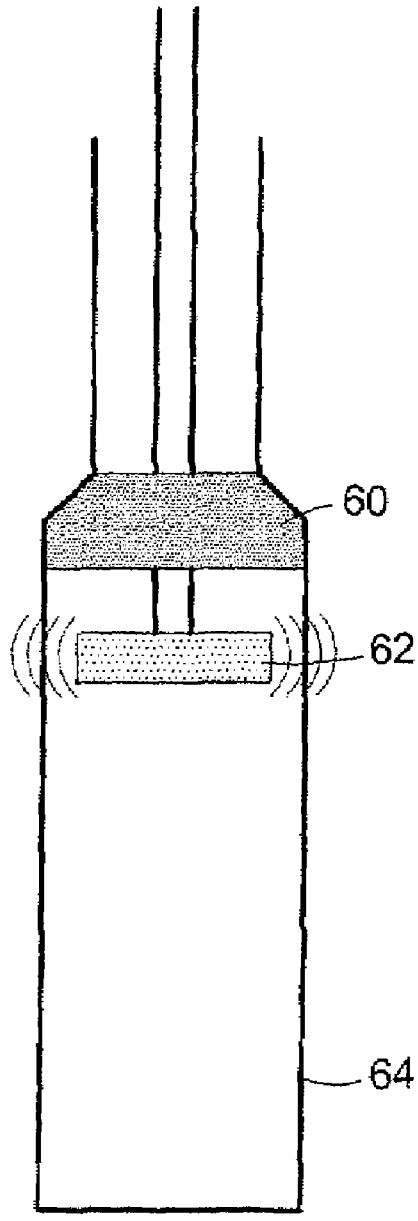

Reference is now made to FIGS. 5 and 6, which are diagrammatic illustrations of a method of expanding and logging a tubular in accordance with another embodiment of the present invention. This embodiment features an expansion device in the form of a cone 60 and a logging tool 62 is mounted below the cone 60. In this embodiment the logging tool 62 is run into the bore with the cone 60.

The log obtained by the tool 62, after expansion of the tubular 64, is compared with other logs obtained from the open hole, from logs obtained before expansion of the tubular, or may be compared with one or more logs obtained later. However, in other embodiments the log obtained by the tool may be utilised directly, without comparison to a previous or subsequent log.

In addition, the tool 62 may also be utilised to capture bore information as the tubular is run into the bore. This may be particularly useful where the bore is such that it is desired to line the bore with expanded tubing as quickly as possible, and it is not possible or desirable to make a separate logging run to log the bore after drilling and before running the tubular into the bore.

Where the sensing tool 62 is to be utilised to capture bore information as the tubular is run into the hole, the housing for the tool 62 may be of an appropriate material to prevent or minimise interference with the logging operation. To this end the sensor housing 66 may be formed of the same or a different material from the remainder of the tubular, and may be formed of, for example, steel, a non-magnetic metal or a non-metallic material, such as a composite. The sensor housing 66 may also be selected to be readily drillable.

The log may provide information relative to one or more conditions in the bore proximate the expansion device, for example a parameter indicative of the quality of the seal between the tubular and the bore wall, tubular wall thickness, or some other feature related to the placement or expansion of the tubular in the bore. Alternatively, or in addition, the log may relate to a petrophysical parameter, and may be a gamma ray, nuclear magnetic resonance (NMR), pulse neutron capture (PNC), TDT, CBL, diplog, carbon oxygen or production log.

The log obtained by the tool 62 may then be compared with a log obtained by a similar logging tool from a logging operation carried out in the open hole, or may be compared with a log obtained using a different logging tool, for example a resistivity, FDC/CNL, gamma ray or sonic log. The open hole log may have been obtained in a logging while drilling (LWD) operation or in a logging operation carried out after drilling. Alternatively, the feature may be determined by seismic means, including but not limited to a feature determined by downhole seismic testing.

The feature determined by the sensing device 62 may be compared with a feature determined subsequently, for example after further well completion operations, after the well has been producing for a time, or before a subsequent well work-over. The feature may be determined as part of a "4-D" survey, in which features of a production reservoir are determined at spaced time intervals.

Figure 7:
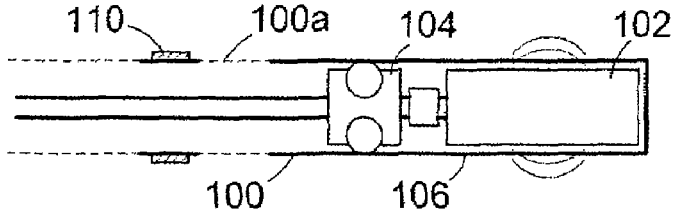
FIGS. 7, 8 and 9 are diagrammatic illustrations of a method of logging a bore and then selectively expanding a tubular in accordance with a still further embodiment of the invention.
Figure 8:
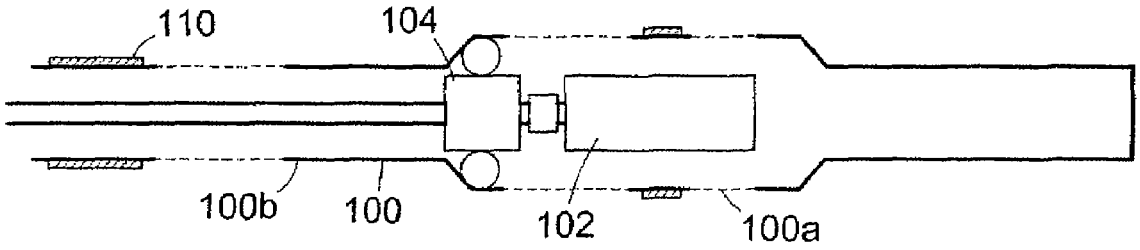
Figure 9:
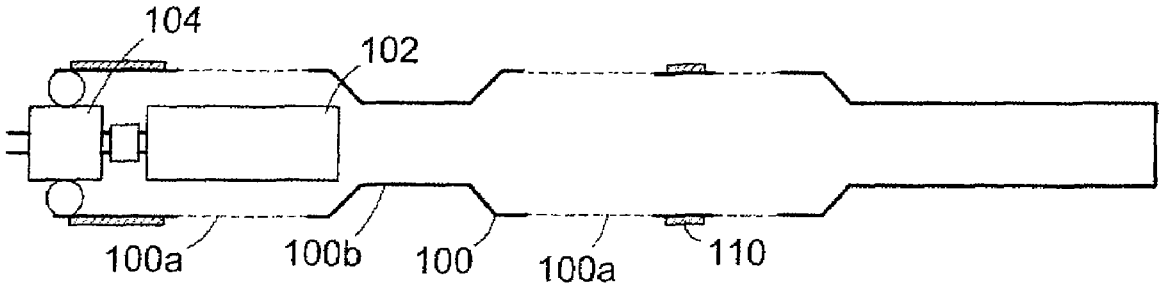

Reference is now made to FIGS. 7, 8 and 9 of the drawings, which are diagrammatic illustrations of a method of logging a bore and then selectively expanding a tubular 100 in accordance with a still further embodiment of the invention. In this embodiment a logging tool 102 and energisable expansion tool 104 are run into an unlined section of bore with the tubular 100, the logging tool 102 gathering information on the bore as the tool 102 passes through the bore. This information may include the nature of the surrounding formations, for example whether the bore extends through shale or sand, or whether the surrounding formations contain hydrocarbons or water, and the transitions between the different formations.

Depending on the nature of the logging tool 102, the tool 102 may be housed in a non-magnetic or non-metallic housing 106. The remainder of the tubular 100 is made up of a combination of sandscreen 100*a* and solid or blank pipe 100*b*, and expandable annular seals 110 are positioned at appropriate points on the tubular 100.

The log obtained from the tool 102 may be utilised to determine the most appropriate location for the tubular 100, ensuring that, for example, water-bearing formations are isolated by solid pipe 100*b* and seals 110 from the sandscreen 100*a*, which is located across the hydrocarbon-bearing formations. The log may also be utilised to determine which sections of the tubular 100 should be expanded, and to what degree. In the illustrated embodiment it will be noted that FIG. 9 illustrates an unexpanded section of solid pipe 100*b* located between two expanded sandscreens 100*a*. In other embodiments the solid pipe 100*b* may be expanded or partially expanded.

The logging tool 102 may remain activated during or following expansion, and the tool 102 may be capable of producing a number of different forms of logs, such that, for example, the exact form of the expanded tubular may monitored following the expansion of the tubular 100. Optionally, an intelligent completion, including packers, sensors and appropriate control lines, may be installed subsequently and utilised to identify the form of the tubular.

Those of skill in the art will recognise that the above described embodiments are mainly exemplary of the scope of the present invention, and other various modifications and improvements may be made thereto, without departing from the scope of the invention. If desired, the operations illustrated in FIGS. 3 and 4 may be combined with the operations illustrated in FIGS. 7, 8 and 9.

The invention claimed is:

1. A method of expanding a tubular in a wellbore, the method comprising:

mounting a sensing device in the wellbore;

expanding at least a portion of the tubular;

engaging the sensing device with a retrieving device; and translating the sensing device through the expanded tubular.

2. The method of claim 1, wherein the sensing device is mounted in a second tubular that is coupled to the expanded tubular.

3. The method of claim 1, wherein the sensing device is engaged by the retrieving device following expansion of the portion of the tubular.

4. The method of claim 1, wherein the sensing device is operable for sensing at least one of a parameter and a condition of at least one of: the tubular; a second tubular surrounding the expanded tubular; a fluid in the tubular; an earth formation surrounding the tubular; fluid within an earth formation surrounding the tubular; and an annulus surrounding the tubular.

5. The method of claim 1, wherein the sensing device determines at least one of: a feature of the expanded tubular; an inner diameter of the expanded tubular; and a form of the expanded tubular.

6. The method of claim 1, wherein the sensing device comprises a memory calliper.

7. The method of claim 1, wherein the sensing device comprises a logging device, and further comprising logging the expanded tubular while the sensing device is retrieved.

8. The method of claim 1, wherein the sensing device is operable to determine areas of at least one of tubular-to-borehole and tubular-to-tubular contact.

9. The method of claim 1, wherein the sensing device is operable to determine quality of cementation.

10. The method of claim 1, wherein the sensing device is operable to provide an indication of tubular wall thickness.

11. The method of claim 1, wherein the retrieving device comprises an expansion device, and wherein the expansion of the tubular and the translation of the sensing device through the expanded tubular are completed in a single trip.

12. The method of claim 1, wherein the retrieving device comprises an expansion device, and wherein the sensing device is picked up by the expansion device following expansion of the tubular.

13. The method of claim 1, further comprising flowing the wellbore while operating the sensing device.

14. The method of claim 13, wherein the sensing device comprises a flow meter, and further comprising estimating a production profile of the wellbore.

15. The method of claim 13, wherein the sensing device measures at least one of fluid density and fluid hold-up.

16. A method of expanding a tubular in a wellbore, the method comprising:

positioning a sensing device in the wellbore;

expanding a portion of the tubular in the wellbore;

engaging the sensing device with a retrieving device, thereby activating the sensing device; and retrieving the sensing device from the wellbore.

17. The method of claim 16, wherein the sensing device is mounted in a second tubular that is coupled to the expanded tubular.

18. The method of claim 16, further comprising further expanding the portion of the tubular while retrieving the sensing device.

19. The method of claim 16, further comprising measuring a feature of the expanded tubular while retrieving the sensing device.

20. A method of expanding a tubular in a wellbore, the method comprising:

mounting a sensing device in the wellbore;

expanding a portion of the tubular and then engaging the sensing device with a retrieving device; and translating the sensing device through the expanded tubular.

* * * * *